United States Patent [19]

Diaz et al.

[11] Patent Number: 4,853,704

[45] Date of Patent: Aug. 1, 1989

[54] NOTCH ANTENNA WITH MICROSTRIP FEED

[75] Inventors: Leopoldo J. Diaz, Golden; Daniel B. McKenna, Broomfield; Todd A. Pett, Longmont, all of Colo.

[73] Assignee: Ball Corporation, Muncie, Ind.

[21] Appl. No.: 197,250

[22] Filed: May 23, 1988

[51] Int. Cl.[4] ..... H01Q 13/08

[52] U.S. Cl. ..... 343/767; 343/770; 343/829

[58] Field of Search ..... 343/767, 768, 770, 771, 343/772, 778, 786, 825, 829, 828, 846, 708, 700 MS, 729; 333/26, 34

[56] References Cited

U.S. PATENT DOCUMENTS 4,370,659 1/1983 Chu et al. ..... 343/786

FOREIGN PATENT DOCUMENTS 257881 3/1988 European Pat. Off. .

3215323 7/1983 Fed. Rep. of Germany ..... 343/768

493695 10/1938 United Kingdom ..... 343/767

OTHER PUBLICATIONS

Prasad et al., "A Novel MIC Slot-Line-Antenna", Proceed. of Europ. Microwave Conf., Microwave '79, Brighton, England (Sep. 17-20, '79).

*Primary Examiner*—Rolf Hille

*Assistant Examiner*—Michael C. Wimer

*Attorney, Agent, or Firm*—Gilbert E. Alberding

[57] ABSTRACT

The subject invention provides an improved conformal antenna array assembly having a strip conductor, a ground plane separated from and lying parallel to said strip conductor, said ground plane having a slot therein, said slot extending transverse to said strip conductor, a conductive planar element positioned across said slot and orthogonal to said ground plane, said conductive planar element having curved surfaces extending upwardly and outwardly from said slot. The strip conductor or microstrip and the slot-containing ground plane are separated by a dielectric material.

25 Claims, 1 Drawing Sheet

NOTCH ANTENNA WITH MICROSTRIP FEED

BACKGROUND OF THE INVENTION

This invention relates to an improved printed radiating element antenna, and most particularly, to a novel slot antenna structure with integral feeding means and array arrangements formed therefrom.

In designing an antenna for radio frequency energy it is important that the antenna be compatible with the feeding network, that is, the transitional device that is to be employed between the antenna element and the feed means to excite the element should be one with little or no discontinuity that would cause bandwidth restrictions.

In seeking a broadband antenna compatible with a feed network, light in weight, rugged in construction and yet simple to construct, the choices available to an antenna engineer are rather limited. Seemingly, a possible candidate having relative good broadband characteristics would be the so-called dual-ridge antenna for transmitting and receiving electrical signals. In general, such an antenna may comprise a ground plane with a pair of matching directional elements or ridges that may extend perpendicularly from a ground plane and have facing inner curved surfaces which converge toward the grounded plane and terminate at a predetermined distance from the ground plane and from each other. At a point of minimum separation between the matching directional elements a transmission line may be readily utilized to excite the matching elements, generally by means of a coaxial feed assembly. It is generally known that when such an assembly or transition is used as a feed line to such a dual-ridge type antenna there may be some discontinuity, in practice, that may often limit or alter electrical characteristics, especially the antenna's bandwidth. Moreover, a dual-ridge antenna is not generally a structure that lends itself to a multiple connection feeding networks as would be necessary in a conformal array structure. Further, dual-ridge antennas with associated transitional devices are generally more difficult to manufacture in a reliable and consistent fashion.

In designing an antenna along with any necessary impedance-matching or power-dividing circuit component associated therewith, an antenna designer must make the antenna perform a desired electrical function which includes, among other things, transmitting-/receiving linearly polarized, right-hand circularly polarized, left-hand circularly polarized, etc., r.f. signals with appropriate gain, bandwidth, beamwidth, minor lobe level, radiation efficiency, aperture efficiency, receiving cross section, radiation resistance as well as other electrical characteristics.

It is advantageous for an antenna structure to be lightweight, simple in design, inexpensive and unobtrusive to the environment since the antenna is often required to be mounted upon or secured to a supporting surfaces, such as are often associated with a motorized vehicle, high velocity aircraft, missile, or rocket device which cannot, of course, tolerate excessive deviations from an aerodynamic geometry. Of course, it is also sometimes desirable to conceal or hide an antenna or an array so that its presence is not readily apparent for security as well as aesthetic purposes. Accordingly, the ideal antenna should physically be very thin and not protrude on an external side of a mounting surface, such as an aircraft skin or the like, while yet still exhibiting all the requisite electrical characteristics.

Antennas having very low profiles which can be flush mounted on a supporting surface are generally referred to as conformal antennas. As mentioned, such an antenna conforms to the contour of its supporting surface, and, therefore, reduces or eliminates any turbulent effects that would result when such a device is mounted or secured, for example, to a vehicle and propelled through space. Conformal antennas may, of course, be constructed by several methods, but can be generally produced by rather simple photoetching techniques well-known in the art. Such techniques offer ease of fabrication at a relatively low production cost. Briefly, conformal antennas or printed circuit board antennas, as they may be called, are formed by etching a single side of a unitary metallically clad dielectric sheet or electrodeposited film using conventional photoresist-etching techniques. Typically, the entire antenna structure may possibly be on 1/32 inch to ⅛ inch thick which minimizes cost and maximizes manufacturing/operating reliability and reproducibility.

It can be appreciated that the cost of fabrication of such printed circuit board antennas is substantially minimized since single antenna elements and/or arrays of such elements together with appropriate r.f. feedlines, phase shifting circuits and/or impedance matching networks may all be manufactured as one integrally formed electrical circuit by using low cost photoresist-etching processes commonly used to make electronic printed circuit boards. This method of producing an antenna structure is to be compared with the often complicated and costly prior art techniques for fabrication of antennas for achieving polarized radiation patters as, for instance, a turnstile dipole array, the cavity backed turnstile slot array and other special antennas.

Antennas of the type considered herein, viz., flared notch type antenna, have been configured in various forms. Briefly, U.S. Pat. No. 2,942,263 to Baldwin teaches a conventional notch antenna device. Further, U.S. Pat. No. 2,944,258 to Yearout, et al., discloses a dual-ridge antenna as previously disclosed having a broad bandwidth. U.S. Pat. No. 3,836,976 to Monser, et al., discloses a broadband phased array antenna formed by pairs of mutually orthogonal printed radiating elements, each one of such elements having a flared notch formed thereon. Monser et al., teaches a feed means in the form of a coaxial cable that is soldered to a metallization layer, this may generally cause some discontinuity which often limits the bandwidth of an antenna. On the other hand, U.S. Pat. No. 4,500,887 to Nester discloses a broadband radiating element designed to provide a smooth, continuous transition from a microstrip feed configuration to a flared notch antenna.

SUMMARY OF THE INVENTION

An object of the subject invention is to provide an antenna which is compatible with broadband applications and microstrip circuitry.

Another object of the subject invention is to provide an antenna and its assorted feeding means that offers an integral and smooth transition with substantial reduction in undesirable discontinuity therebetween.

Another object of the subject invention is to provide an array of antenna elements capable of transmitting and receiving r.f. energy over a broad frequency range.

A still further object of the subject invention is to provide a method and device in the form of a transitional means between a notch antenna and a microstrip feed line.

It is yet another object of the subject invention to provide a novel broadband antenna device light in weight, compact design and relatively small in volume.

It is further an object of the subject invention to provide an improved conformal antenna array with associated feeding means having simplicity of design and ease of fabrication.

These and other objects of the invention are attained by providing an antenna comprising a strip conductor, a ground plane separated from and lying parallel to said strip conductor, said groupd plane having a slot therein, said slot extending transverse to said strip conductor, a conductive planar element positioned across said slot and orthogonal to said ground plane, said conductive planar element having curved surfaces extending upwardly and outwardly from said slot. The strip conductor and the ground plane provided with a slot are separated generally by a dielectric, said dielectrics being either air or a solid material.

A conductor or a strip conductor is generally formed by photoetching a metallized layer on solid dielectric substrate. Such metallized conductors serve as transmission lines and are referred to as microstrip transmission lines. Thus, such a conducting structure line consists of a metallized strip and a ground plane separated by a solid dielectric and support, as a consequence, an almost pure TEM mode of propagation. It will be appreciated that the composition of the dielectric substrate may be of a very wide range of material since, in practice, a wide variety of materials will function, including polyethylene, polytetrafluoroethylene, (PTFE), polyisobulylene, silicon rubber, polystyrene, polyphenylene, alumina, beryllia and ceramic. Any dielectric that can properly offer support for the conducting antenna elements will answer.

In a notch antenna structure herein, the two metallizations that make up the conducting patches are situated on a planar dielectric substrate and are spaced apart one from the other so that the edges of each metallization that are adjacent one another present curved edges that are separated by varying distances. It will be appreciated that the facing edges of each metallization are curved in either a complimentary manner or noncomplimentary manner. When complimentary, the curved edge has a point along the curve at which the other portion of the curve is the same or substantially the same so that upon being theoretically folded along a meridian bisecting the metallizations the curved portion would substantially coincide or mate with the other portion. On the other hand, the curves may be considered noncomplimentary if, when theoretically folded, the curves do not coincide or substantially mate with one another.

The two metallizations may be viewed as a flared notch configuration in which a gap is formed at a relatively narrow portion of the antenna structure where there is convergence of the two metallizations and a mouth is formed at a wider portion therefrom, the two metallizations having their notch configuration derived commonly from the gap formed therebetween. In practice, a dual flared notch may be generally designed as to curve exponentially outwardly from the gap portion, the edges of the metallizations facing one another and generally curving outwardly according to a continuous function. This function may be a linear function or a parabolic one.

An antenna assembly is disclosed having broadband applications and comprises a dielectric material, a two-conductor transmission line, one line being strip conductor formed on one side of said dielectric material and the other line formed as a ground plane on the other side of said dielectric material for propagation of a signal within a predetermined frequency range in quasi-TEM mode via said strip conductor, said ground plane being provided with a slot therein, said slot extending transverse to said strip conductor and terminating approximately one-quarter wavelength beyond one side of said strip conductor, a dual ridge antenna device positioned normal to said slot and orthogonal to said ground plane, said dual ridge antenna device having metallizations in electrical contact with said ground plane, each ridge of said dual ridge antenna device extending outwardly from said slot according to a continuous function.

DESCRIPTION OF THE PREFERRED EMBODIMENTS

Figure 1:
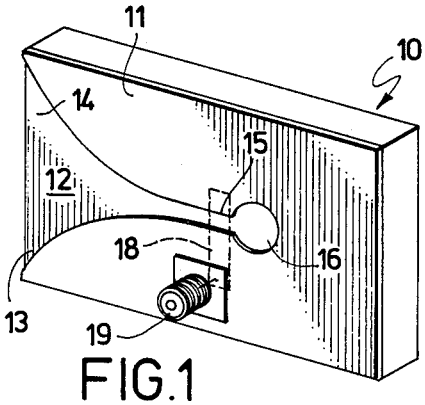
FIG.1 (PRIOR ART)
FIG. 1 shows a schematic illustration of a prior art single notch radiating element with an open slot line termination.

A conventional (prior art) notch antenna device 10 is shown in FIG. 1 and consists of a metallization 11 situated on and integrally connected to a dielectric substrate 13. The notch antenna device 10 has a mouth 14 and a narrow slot line 15 that are interconnected by a gradual transition as shown in FIG. 1. It is to be noted that a slot line open circuit 16 is formed at the base of the slot line 15, the slot line open circuit 16 being required for impedance matching the antenna device to a transmission line. The cavity 16 places, nonetheless, a limitation on the ratio of high to low frequencies that the notched antenna device 10 can properly receive or transmit. The radiation pattern is unidirectional and generally provides bandwidth usually not exceeding about 4:1. It should be noted that this particular notch antenna configuration requires that the transmission line 18 be positioned so that it lies in a plane parallel to and spaced from the plane of the tapered slot or notch device 10.

Figure 2:
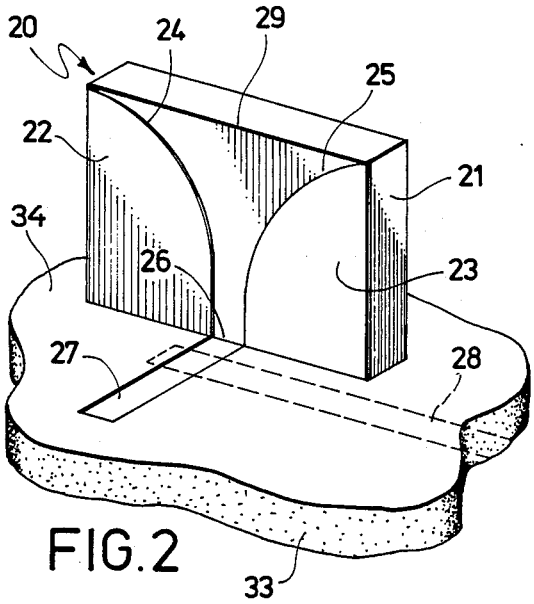
FIG. 2 shows an isometric illustration of the subject invention herein disclosed and claimed.
Figure 3:
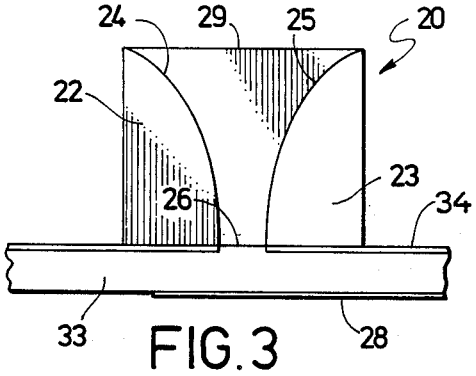
FIG. 3 shows a cross-sectional elevational view of an antenna constructed in accordance with the subject invention.
Figure 4:
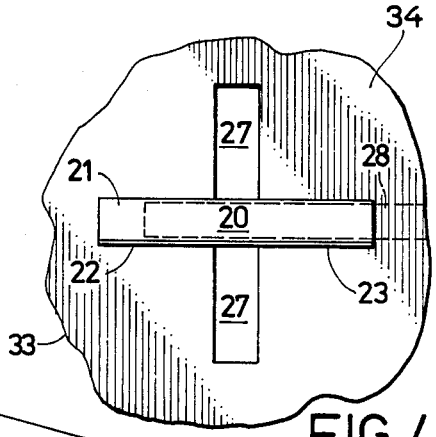
FIG. 4 shows a top plan view of the antenna structure shown in FIG. 3.

An antenna element of the subject invention is illustrated in FIGS. 2, 3 and 4. A notch antenna element 20 for receiving and transmitting electromagnetic waves includes a planar substrate 21 such as a dielectric material. As previously mentioned, such materials may be composed of a dielectric or ceramic material PTFE composite, fiberglass reinforced with crosslinked polyolefins, alumina and the like. On one side of the surface substrate, a first and second metallizations 22 and 23, respectively, are bonded thereto and spaced apart as shown. The first and second metallizations, 22 and 23, have adjacent and facing edges 24 and 25 that extend across the surface of substrate 21 and curve outwardly and remain spaced apart. It should be appreciated that the edges 24 and 25 are very thin since the metallizations are generally deposited by electrochemical deposition, generally having a thickness of about 0.0015 inch or less.

In FIGS. 2, 3 and 4, the two metallizations 22 and 23 of notch antenna 20 approach one another at 26 to form a small spacing or gap 26 therebetween. The two metallizations 22 and 23 define a flared notch antenna device in which a gap 26 is formed at the narrow approach between the metallizations at one end and a mouth portion 29 at the other end.

As best seen in FIG. 2, notch antenna 20 is positioned on and affixed orthogonally to a conductive reference ground plane 34 which, in turn, is bonded to a dielectric base 33 and the antenna 20 is so positioned that the gap 26 is in alignment with a slot 27 which has been formed in said ground plane 34. As best depicted in FIG. 4, slot 27 is as situated in relation to antenna 20 so that the slot passes normal to the antenna 20, extending on both sides thereof. To one side of substrate 21 a microstrip transmission line 28 is affixed to the bottom portion of base 33 and is situated normal to the slot 27. It can be appreciated that this arrangement allows the microstrip transmission line 28, during passage of r.f. signal energy from a source, to be capacitively coupled to the slot 27 formed in the reference ground plane 34 and this, in turn, causes excitation of the tapered slot between metallizations 22 and 23 to produce a radiation pattern. The slot 27 contributes to the radiation pattern at the high frequencies.

It can be appreciated that this arrangement allows, in a straightforward fashion, feeding means to the notch antenna through a conventional microstrip transmission line. As can be further appreciated, prior arrangements have required that the microstrip feeding means be in a plane positioned parallel to a antenna structure which more or less results in an unfavorable geometry. In accordance with the subject invention, the microstrip transmission line is situated in a plane perpendicular to the plane of the tapered notch and, thus, is more symmetrical in design and a more favorable geometry. Thus, the coupling of r.f. electromagnetic energy to such structures, e.g., a broadband tapered notch antenna printed on a circuit board, may be readily accomplished by mounting the printed-circuit board orthogonally to a conductive ground plane and exciting the slot in the ground plane via the microstrip transmission line situated on the other side of the ground plane.

Figure 5:
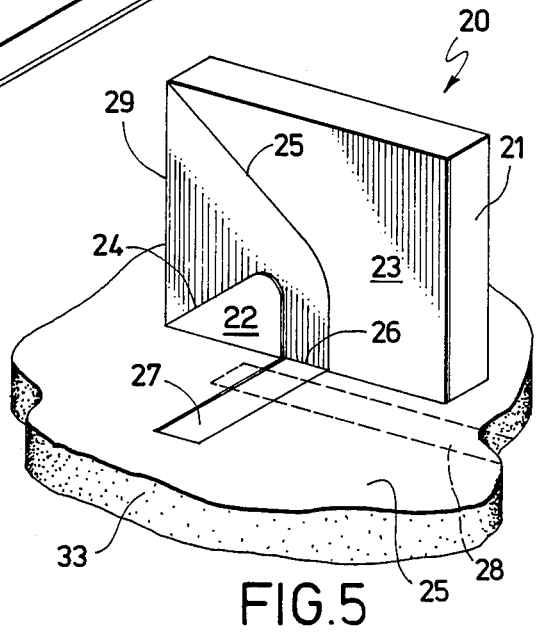
FIG. 5 shows another embodiment in accordance with the subject invention.

Another embodiment is shown in FIG. 5 in which a dielectric material 33 is provided for support on the bottom portion or side of a microstrip transmission line 28 and the other side a ground plane 25 having a slot 27 therein, the ground plane 34 being a supporting surface for and integrally connected to a broadband notch antenna element 20 comprising rectangular substrate 21 having two metallizations 22 and 23 that are conductively coupled to the ground plane 34. In this embodiment the metallizations forming the notch antenna 20 are bent to one side as shown. As can be appreciated, both embodiments, FIG. 2 and FIG. 5, are notch antenna that act as transformers that match and guide electromagnetic waves to and from free space.

From the description given above it can be seen that the present invention provides a new combination of a notch antenna structure with a microstrip transmission line that eliminates discontinuities and provides a straightforward method and structure for directly feeding or receiving r.f. energy in an inexpensive and easily-manufacturable manner that remains compatible with broadband applications and microstrip circuitry.

In operation, the notch antenna device 20 is fed by a microstrip transmission line and, so when supplied with r.f. energy, it creates a near field across the flared notch which thereby establishes the propagation of the far field radiation. It will be appreciated that the polarization of such a notch antenna is somewhat analogous to that of a simple dipole antenna in that radiation is launched linearly from the notch with the E-vector component lying in the plane of the planar substrate 21 and the H-vector component being normal thereto.

Figure 6:
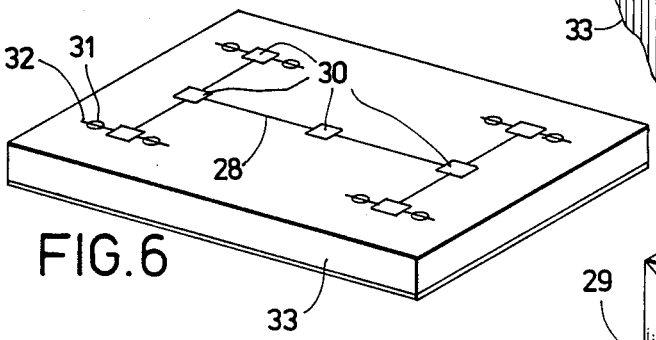
FIG. 6 shows an array arrangement as viewed from the base or bottom side for feeding an antenna array.

The subject invention also contemplates its application in array structures and, in particular, phased array arrangements. Prior to the subject invention, it was difficult to feed such structures. The subject invention provides the means to feed a broadside, a linear or planar array whose direction of maximum radiation is perpendicular to the line or plane of the array, as well as end-fire, linear array antennas whose direction of maximum radiation is parallel to the line of the array in such a way with a microstrip distribution network without plated through holes or other difficult and expensive devices. FIG. 6 is a bottom view of an antenna having an array arrangement for feeding the same and the microstrip transmission line 28 is connected to a network of power combiners 30 which distribute the power to fixed or variable action or passive phase shifters 31 and from these to microstrip feed lines 32.

Although only a few exemplary embodiments of this invention have been specifically described above, those in the art will appreciate that many variations and modifications may be made in the exemplary embodiment without substantially departing from the unique and novel features of this invention. Accordingly, all such variations and modifications are intended to be included within the scope of this invention as defined by the following appended claims.

We claim:

1. A broadband antenna comprising a strip conductor lying in a first plane, a ground plane separated from and lying parallel to said strip conductor, said ground plane having a slot therein, said slot extending transverse to said strip conductor, two substantially planar conductive elements positioned in a substantially common plane that transverses said slot and is substantially orthogonal to said first plane and said ground plane, each of said conductive elements having at least one curved surface extending upwardly and outwardly from said slot, one of said conductive elements contacting said ground plane on one side of said slot and the other of said conductive elements contacting said ground plane on the other side of said slot, wherein during use said strip conductor and said slot are capacitively coupled.

2. A broadband antenna as recited in claim 1 where said conductive elements are symmetrically mounted relative to said slot.

3. A broadband antenna as recited in claim 1 wherein each said conductive planar elements comprises a metallization disposed on a dielectric substrate.

4. A broadband antenna as recited in claim 1 wherein the slot is a parallelogram opening in the ground plane.

5. A broadband antenna as recited in claim 4 wherein the length of said parallelogram opening is one half of a wavelength at the highest operating frequency.

6. A broadband antenna as recited in claim 1 wherein the curved surfaces of said conductive planar elements each comprise a separate metallization bound by a radii and an included curved edge to define said curved surfaces for transmitting and receiving electromagnetic waves.

7. A broadband antenna as recited in claim 6 wherein the curved edges of the two separate metallizations are in close proximity and spaced apart from one another to define at the closest proximity a gap therebetween.

8. A broadband antenna as recited in claim 6 wherein the curved edge of each metallization flares outwardly according to a continuous function.

9. A broadband antenna as recited in claim 8 wherein said continuous function is selected from the group comprising parabolic, linear and exponential functions.

10. A broadband antenna as recited in claim 1, wherein said slot extends laterally away from said common plane of said conductive elements.

11. A broadband antenna as recited in claim 10, wherein said slot extends perpendicularly away from said common plane of said conductive elements.

12. A broadband antenna as recited in claim 1, wherein said slot extends laterally away from said strip conductor for a length substantially equal to one-quarter of a wavelength at the highest operating frequency.

13. A broadband antenna as recited in claim 1, wherein said strip conductor is substantially parallel to said common plane of said conductive elements.

14. A broadband antenna as recited in claim 1, wherein said strip conductor is substantially disposed on one side of said common plane of said conductive elements.

15. An antenna assembly comprising a dielectric material, a two-conductor transmission line, one line being a strip conductor formed on one side of said dielectric material and the other line formed as a ground plane on the other side of said dielectric material, said ground plane being provided with a slot therein, said slot extending transverse to said strip conductor, a notch antenna element positioned normal to said slot and orthogonal to said ground plane, said notch antenna element having at least two metallizations in electrical contact with said ground plane and extending from said slot according to a continuous function.

16. An antenna assembly as recited in claim 15 wherein said slot is rectangular.

17. An antenna assembly as recited in claim 16 wherein said rectangular slot has a length of one half of a wavelength at the highest operating frequency.

18. An antenna assembly as recited in claim 15 wherein the metallizations have curved edges separated by a predetermined gap.

19. An antenna assembly as recited in claim 18 wherein the curved edges follow a continuous function.

20. An antenna assembly as recited in claim 19 wherein said continuous function is selected from the group comprising parabolic, linear and exponential functions.

21. An antenna assembly as recited in claim 15 wherein the metallizations of said notch antenna element, the strip conductor and ground plane are formed on said dielectric material by electrodeposition.

22. An antenna assembly as recited in claim 15 wherein the assembly further includes a phase shifter connected to said strip conductor.

23. An antenna assembly comprising a dielectric material, a two-conductor transmission line, one line being a strip conductor formed on one side of said dielectric material and the other line formed as a ground plane on the other side of said dielectric material for propagation of a signal within a predetermined frequency range in a quasi-TEM mode via said strip conductor, said ground plane being provided with a slot therein, said slot extending transverse to said strip conductor and terminating approximately one-quarter wavelength beyond one side of said strip conductor, a dual ridge antenna device positioned normal to said slot and orthogonal to said ground plane, said dual ridge antenna device having metallizations in electrical contact with said ground plane, each ridge of said dual ridge antenna device extending outwardly from said slot according to a continuous function.

24. An antenna assembly as recited in claim 23 wherein said slot is rectangular.

25. An antenna assembly as recited in claim 23 wherein the metallizations define side ridges and are separated from one another to form at the closest proximity a gap therebetween.

* * * * *